US008069604B2

(12) United States Patent
Larue

(10) Patent No.: US 8,069,604 B2
(45) Date of Patent: Dec. 6, 2011

(54) HAND-GUARD / BARREL NUT CLAMP ASSEMBLY FOR TACTICAL FIREARM

(76) Inventor: Mark C. Larue, Leander, TX (US)

( * ) Notice: Subject to any disclaimer, the term of this patent is extended or adjusted under 35 U.S.C. 154(b) by 417 days.

(21) Appl. No.: 11/191,199

(22) Filed: Jul. 27, 2005

(65) Prior Publication Data

US 2007/0017139 A1 Jan. 25, 2007

Related U.S. Application Data

(60) Provisional application No. 60/592,277, filed on Jul. 29, 2004.

(51) Int. Cl.
*F41A 21/00* (2006.01)

(52) U.S. Cl. ..... 42/75.1

(58) Field of Classification Search ..... 42/75.01; 403/11–14, 16–22
See application file for complete search history.

(56) References Cited

U.S. PATENT DOCUMENTS

| | | | | | |
|---|---|---|---|---|---|
| 2,372,568 | A * | 3/1945 | Grigg | 42/75.01 |
| 3,163,952 | A * | 1/1965 | Into | 42/75.01 |
| 4,525,094 | A * | 6/1985 | Johnson et al. | 403/11 |
| 5,412,895 | A * | 5/1995 | Krieger | 42/75.02 |
| 5,590,484 | A * | 1/1997 | Mooney et al. | 42/111 |
| 6,671,990 | B1 * | 1/2004 | Booth | 42/75.01 |
| 6,694,660 | B1 * | 2/2004 | Davies | 42/75.01 |
| RE39,465 | E * | 1/2007 | Swan | 42/71.01 |
| 2004/0049964 | A1 * | 3/2004 | Vais | 42/75.02 |
| 2007/0033851 | A1 * | 2/2007 | Hochstrate et al. | 42/75.01 |

* cited by examiner

*Primary Examiner* — Troy Chambers
(74) *Attorney, Agent, or Firm* — James L. Jackson

(57) ABSTRACT

A hand-guard and barrel nut clamping assembly for tactical firearms and other mechanical equipment that is subject to frequent or sustained vibration or shock, such as when a firearm is subjected to sustained rapid fire and/or the firearm is handled roughly. A small generally half-moon shaped anti-rotation clamping member is secured to a hand-guard support element or other suitable structure by socket head cap screws and is secured in frictional contact with components of the hand-guard mount and a barrel nut. The anti-rotation clamping member functions as a key to "tie" the barrel nut and hand-guard nut together, simultaneously preventing either one from rotating, and thus preventing inadvertent vibration or shock induced loosening of either the hand-guard retainer nut or the barrel nut. The anti-rotation clamping member is also keyed onto the front of the upper receiver by a slot into which a portion of the receiver is engaged. Alignment pins in the hand-guard support element also key a barrel nut against inadvertent rotation and further ensure against loosening of the barrel nut by vibration and shock.

18 Claims, 2 Drawing Sheets

HAND-GUARD / BARREL NUT CLAMP ASSEMBLY FOR TACTICAL FIREARM

Applicant hereby claims the benefit of U.S. Provisional Patent Application No. 60/592,277, filed on Jul. 29, 2004 by Mark C. LaRue and entitled "Hand-guard/Barrel Nut Clamp Assembly for Tactical Firearm", which Provisional Patent application is incorporated herein by reference for all purposes.

BACKGROUND OF THE INVENTION

Field of the Invention

The present invention relates generally to firearms and particularly to tactical rifles that are utilized by tactical and special operations personnel for military and law enforcement activities. More particularly, the present invention concerns hand-guard/clamp assemblies for ensuring against loosening of the barrel nut or the hand-guard retainer nut of a tactical rifle, such as the M4 Carbine currently in use, when such rifles are subjected to shock and vibration due to conditions of harsh treatment or sustained rapid fire. The present invention is also applicable for ensuring the maintenance of a thread connected relation between various types of mechanical components that are typically subject to becoming loosened by significant shock and vibration.

SUMMARY OF THE INVENTION

It is a primary feature of the present invention to provide novel clamp assembly that is designed particularly for the currently used M4 Carbine and which prevents loosening of the barrel nut or the hand-guard retainer nut of a tactical rifle, such as the M4 Carbine currently in use, when the rifle is subjected to shock and vibration due to conditions of rough or harsh treatment or due to the vibration of sustained rapid fire;

It is another feature of the present invention to provide a novel clamp assembly that functions to key the barrel nut of an M4 Carbine or other similar firearm to the firearm receiver and also functions to key the hand-guard retainer nut of the firearm both to the receiver and to the hand-guard support and thus prevent inadvertent vibration or shock induced loosening of these retainer nuts; and It is also a feature of the present invention to provide a novel clamp assembly that prevents loosening of the barrel nut and hand-guard retainer nut of a tactical firearm and which permits easy disassembly and assembly of the firearm by a user, even in field conditions, through the use of simple tools such as an Allen wrench.

Another feature of the present invention is the provision of a novel anti-rotation clamp assembly that effectively maintains a thread connected and properly fitting relation between mechanical components other than firearm components when the thread connected components are subjected to shock and vibration due to conditions of rough or harsh treatment.

Though the present invention is discussed herein particularly with respect to its application to tactical rifles such as the M4 Carbine, it should be borne in mind that it is not intended to limit the spirit and scope of the present invention solely to that particular rifle or to limit application of the invention solely to rifles and firearms. The present invention clearly has a wide range of application to other types of firearms and to other equipment having components that may become loosened due to conditions of severe vibration and shock. Many other uses of the present invention will become obvious to one skilled in the art upon acquiring a thorough understanding of the present invention.

Briefly, the various objects and features of the present invention are realized by a clamp assembly having a clamp plate of generally C-shaped configuration with apertures at respective ends thereof for receiving retainer screws. The retainer screws extend through passages of a soft metal hand-guard mounting element, which is typically composed of aluminum alloy to minimize weight, and are threaded into the hand-guard mounting element or into hard metal retainer nuts. The hard metal retainer nuts may be press-fitted or embedded within a hand-guard support or may be received by retainer nuts that secure the hand-guard support element to the receiver of the firearm. If the hand-guard mount or hand-guard structure is composed of a hard metal such as steel or a suitable composite material, then the retainer screws may be received by internally threaded openings. A key pin extends through a central opening in the clamp plate and serves to key a barrel retainer nut to the receiver of the firearm. The clamp plate further defines a central slot of sufficient width to receive the forward end of the Picatinny rail of the firearm receiver or other receiver structure, thus ensuring that the hand-guard retainer nut is keyed to the receiver and cannot rotate relative to the receiver structure. This feature prevents the hand-guard retainer nut from inadvertently rotating and becoming loosened during shock and vibration resulting from conditions of harsh treatment, impacts with other objects or by the vibration of sustained rapid fire. At least one and preferably a pair of locator pins are positioned within openings of the hand-guard or forearm support element or mount and engage within corresponding openings of the barrel nut and thus prevent the barrel nut from rotating.

A small generally half-moon shaped clamping plate is provided, having two 10-32 socket head cap screws extending through it. The half-moon plate functions as a clamping plate to "tie" the barrel nut and hand-guard nut together and simultaneously preventing either one from rotating relative to the other. This feature prevents inadvertent vibration or shock induced rotation of either the hand-guard or the barrel nut. The clamping plate is also keyed onto the front end of an upper portion of the receiver with a key slot in the clamping plate of sufficient width to receive a portion of the receiver, such as the front end of one of the Picatinny rails. Due to the geometry of the clamping plate, a considerable volume of the material of the clamping plate, defining the key slot, would have to become sheared away in order for the entire hand-guard and barrel nut assembly to be permitted to rotate relative to the receiver and become loosened. It is highly unlikely that a tactical firearm would be subjected to forces of sufficient magnitude to shear the metal of the clamping plate. Moreover, the clamping plate is preferably composed of a hard metal such as stainless steel and thus provides considerable resistance to clamping forces.

The clamp assembly may have other forms as is deemed appropriate. However, in each case the clamp assembly has the function of keying both the barrel nut and the hand-guard retainer nut and preventing them from loosening during shock and vibration resulting from harsh treatment, impacts with other objects or sustained rapid fire.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings

FIG. 1 is a plan view showing the receiver and hand-guard of an M4 carbine designed for tactical application and employing a clamp assembly embodying the principles of the present invention and preventing inadvertent loosening of the barrel and hand-guard retainer nuts during use of the firearm;

FIG. 2 is a longitudinal sectional view taken along line 2-2 of FIG. 1 and showing the internal structure thereof in detail;

FIG. 3 is a transverse sectional view taken along line 3-3 of FIG. 1;

FIG. 4 is an exploded view showing portions of the hand-guard and receiver of a firearm and showing the anti-rotation clamping assembly being located therebetween:

FIG. 5 is an end elevational view showing details of the construction of the barrel nut of FIG. 4;

FIG. 6 is a sectional view showing the detailed structure of the barrel nut of FIG. 4; and FIG. 7 is an end elevational view opposite that of FIG. 6 and showing further details of the barrel nut of FIGS. 4-7.

DETAILED DESCRIPTION OF PREFERRED EMBODIMENT

Figure 1:
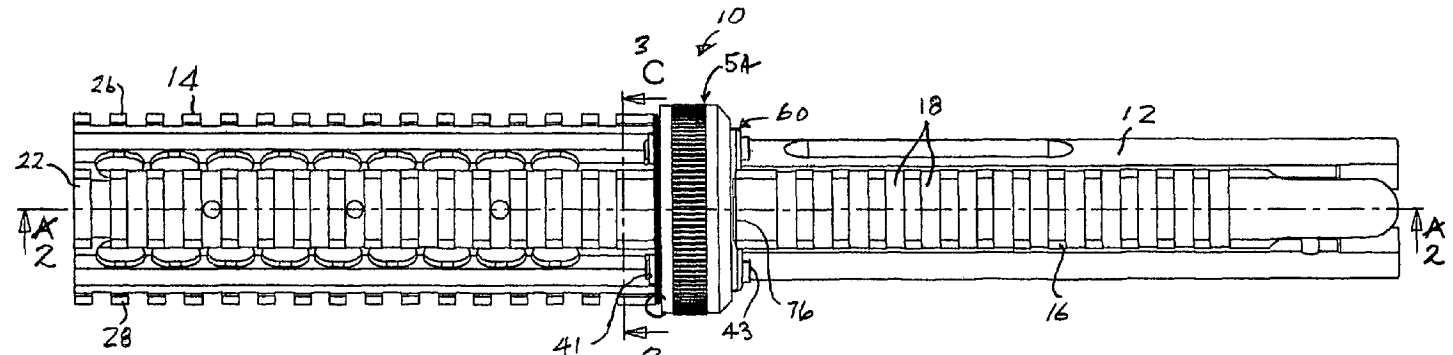
Figure 3:
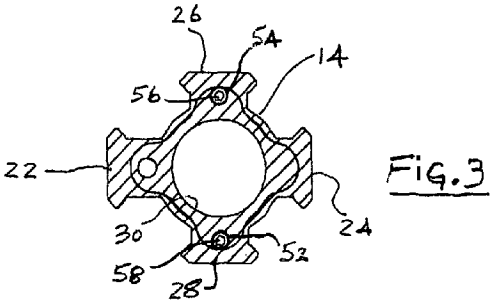
Figure 2:
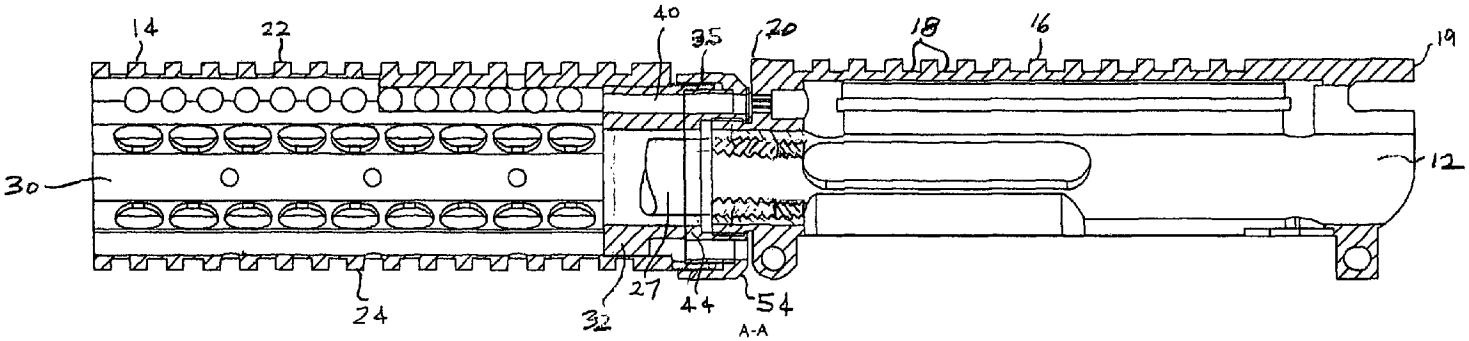

Referring now to the drawings and first to FIGS. 1-3, a section of a firearm or tactical rifle assembly is shown generally at 10 and includes a firearm receiver 12 and a hand-guard 14 that are interconnected by connection of threaded components, thus permitting disassembly of the hand-guard from the receiver for purposes of repair, replacement or cleaning. The firearm assembly 10, shown in the various figures hereof is typically referred to as the M4 Carbine which is widely utilized by the various military organizations of the United States and by various law enforcement organizations. It should be borne in mind however, that it is not intended to limit the spirit and scope of the present invention solely to use in connection with the M4 Carbine, it being obvious that the present invention has application to firearms of other character and also has application to mechanical devices other than firearms. Also, the connection system of the present invention lends itself to mechanical devices other than firearms; thus it is not intended to limit the spirit and scope of the present invention solely to firearms.

The firearm receiver 12, which is composed of a light weight metal, such as aluminum alloy, is provided with an internal barrel receiving thread which is defined by a barrel thread connector composed of steel or other hard metal. The rear, threaded end of a replaceable barrel is fixed within the forward end of the receiver by a suitable hard metal retainer. A barrel nut is received by a forward threaded section of the firearm receiver and serves to prevent the barrel 27 of the firearm from becoming loosened from the firearm receiver when the firearm is subjected to significant vibration and shock forces which typically occur during rapid fire conditions and during handling of the firearm during rough conditions. The firearm receiver 12 defines a sight mounting rail 16, such as a Picatinny rail, which projects upwardly from the firearm receiver and defines multiple transverse slots 18. The Picatinny rail 16 provides for attachment of various sighting devices to the firearm receiver. The Picatinny rail 16 also defines a forward rail end 20 and a rear rail end 19.

The Picatinny rail 16 provides for releasable mounting of sighting devices to a tactical firearm of this nature by means of throw-lever actuated clamp devices which have been developed by this inventor to enable assembly and disassembly of the various sighting devices of the firearm without loss of zero. This is particularly important when a previously zeroed sighting device is re-installed on the sight mounting rail after having been separated from the firearm. Thus, the Picatinny rails and replaceable sighting devices effectively meet an important requirement for effective use of the releasable and adjustable sighting device ring mounts of the present invention by military and law enforcement personnel. The sight mounting system is of light weight construction for ease of firearm handling and yet has sufficient structural integrity to minimize the potential for optics misalignment (loss of zero) by the repeated heavy impacts of weapon firing, especially sustained rapid firing. The Picatinny rail system of the firearm receiver also ensures that sighting devices may be removed and replaced with other sighting devices without loss of zero. This feature is quite important in tactical situations where the sighting devices often require change to meet the light conditions that exist at the time of firearm use.

The hand-guard 14 is typically installed, by releasable threaded connection, ahead of the receiver 12 of the firearm, and provides a suitable forearm or hand-guard structure that is grasped by the offhand of the user to provide for efficient support and handling of the firearm. The barrel 27 of the rifle, a portion of which is shown in the sectional view of FIG. 2, typically becomes heated during firing and can become very hot during sustained fire. It is desirable therefore that the hands of the user do not come into contact with the barrel at any time. The barrel 27 typically extends through a passage 30 of the hand-guard 14 so that the barrel 27 is not exposed for contact by the hands or body of the user when the rifle is fired or otherwise handled.

As shown in FIGS. 1-3, the hand-guard 14 defines four radially projecting Picatinny rails, including upwardly and downwardly oriented rails 22 and 24 and laterally projecting rails 25 and 28. The hand-guard 14 is an essentially hollow structure with multiple openings to minimize weight and defines an internal opening or passage 30 through which the barrel 27 of the firearm extends. The multiple openings of the hand-guard also permit air circulation through the hand-guard structure, thus providing for cooling of the barrel 27. In many tactical applications it is appropriate to provide a tactical rifle having a hand-guard structure having multiple mounting rails such as Picatinny rails, thus permitting other types of tactical devices to be supported by the rifle and used as desired. For example, infrared lighting devices and incandescent lighting devices are often so supported, thus permitting the rifle to be efficiently utilized during conditions of poor ambient light.

Figure 4:
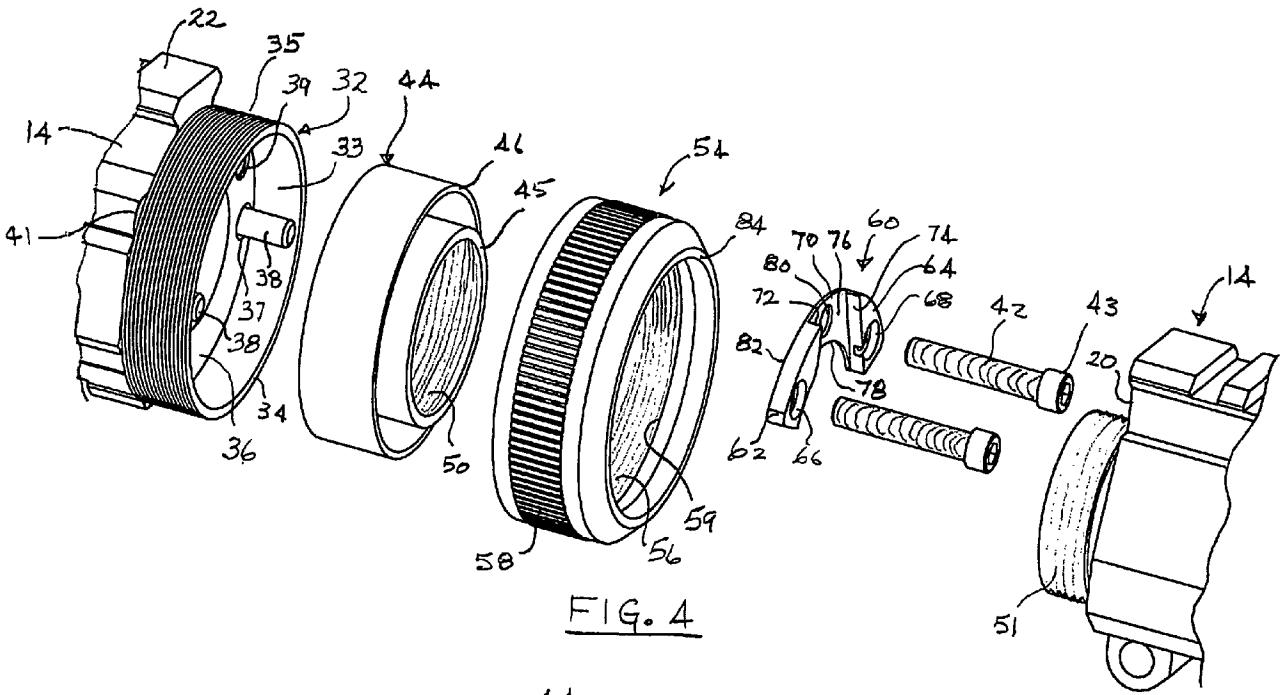
Figure 7:
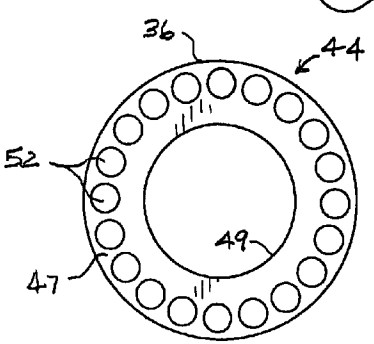
Figure 6:
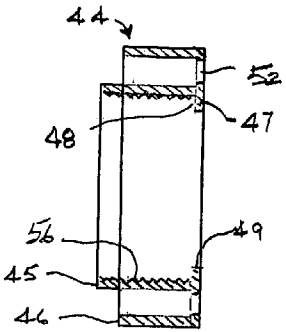
Figure 5:
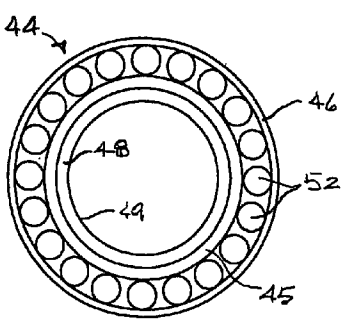

A hand-guard mount, shown generally at 32, is provided at the rear end of the hand-guard 14 and defines an annular seat 33 which is adapted to received a barrel nut 44 shown best in FIGS. 4-7 and described below. As shown in FIG. 4 the annular seat 33 of the hand-guard mount 32 is defined in part by a generally cylindrical rim 34 having an externally threaded section 35. A circular, transversely oriented wall 36 also defines a portion of the circular seat 33 and is provided with openings 37 through which extend one or more alignment pins 38. The wall 36 also defines retainer openings 39 which are in registry with or are defined by internally threaded retainer passages 40 of the hand-guard structure. Since the hand-guard is typically composed of soft light-weight material, such as aluminum alloy, the retainer passages may be defined in part by internally threaded hard metal retainer inserts 41 that are fixed to the hand-guard structure, such as by press-fitting, and are aligned with the retainer passages. The internally threaded retainer inserts 41 receive the externally threaded portions 42 of retainer screws 43 in a manner discussed below.

A barrel nut is shown generally at 44 in FIGS. 4-7 and is preferably an integral element that defines inner and outer substantially concentric rims 45 and 46 that project axially from a substantially planar wall 47. The planar wall 47 extends radially inwardly of the inner concentric rim 45 and defines an annular stop flange 48 that also defines a substantially circular opening 49. The inner concentric rim 45 is internally threaded as shown at 50 and is adapted for threaded engagement with an externally threaded annular projection 51 of the firearm receiver shown generally at 14. Typically the barrel nut is threaded onto the externally threaded annular projection 51 until the annular stop flange 48 engages the circular forward end of the annular projection 51 of the firearm receiver. When fully threaded to the externally threaded annular projection 51 the barrel nut functions to establish locking and retaining engagement with an end portion of the barrel 27 and secure the barrel in fully seated and immovable relation with the receiver member 14. The planar wall 47 of the barrel nut 44 defines a circular array of multiple openings 52 that are located between the inner and outer concentric rims 45 and 46. While most of the openings 52 are for the purpose of weight minimization, two of the openings are oriented to receive the alignment pins 38 of the barrel nut receptacle 33 to prevent the possibility of rotation of the barrel nut when it is seated within its seat or receptacle 33. Another two of the openings 52 of the barrel nut are spaced and oriented for registry with the retainer openings 39 of the hand-guard mount 32 and provide openings through which the retainer screws 43 extend.

An annular hand-guard retainer nut, shown generally at 54, defines an internally threaded section 56 that is adapted for threaded engagement with the externally threaded section 35 of the hand-guard mount 32, and is manually rotated to tighten or loosen the assembly of the hand-guard with respect to the firearm receiver 14. The annular hand-guard retainer nut 54 is provided with external knurling 58 to permit a user to manually rotate the hand-guard retainer nut to tighten it to secure the hand-guard to the firearm receiver or to loosen it for removal of the hand-guard from the firearm receiver. The alignment pins 38 serve to key the barrel nut to the firearm receiver and to ensure that the barrel nut is prevented from rotation within its receptacle 33. An internal shoulder 59 within the hand-guard retainer nut is positioned for retaining engagement with the outer concentric rim 46 of the barrel nut 44 and maintains the barrel nut fully and securely seated within the barrel nut receptacle 33 when the hand-guard retainer nut is tightened. When the firearm receiver member and the hand-guard are separated, the annular hand-guard retainer nut 54 is maintained in rotatable assembly with the firearm receiver member 14 by the barrel nut 44. Thus, to assemble the hand-guard member 32 and the receiver member 14 the hand-guard and receiver are simply moved together and oriented to cause the alignment pins to engage within desired pair of the openings 52 of the barrel nut. When this occurs, the retainer openings 39 are oriented to receive the threaded shafts 42 of the retainer screws 43. The hand-guard is then moved toward the firearm receiver 14, causing the barrel nut to be seated within the receptacle 33 and with the alignment pins being located within respective openings 52. By simply rotating the annular hand-guard retainer nut 54 the threads 35 and 56 are made up thus securing the hand-guard to the receiver and establishing a non-rotatable relation of the hand-guard and firearm receiver.

As mentioned above, it is desirable to prevent inadvertent loosening rotation of the barrel nut and the hand-guard retainer nut when the firearm is subjected to vibration, shock forces and the like, which could cause the firearm to malfunction, fail to function or become dangerous to use. In the event a condition of this nature should develop, especially when the firearm is needed for rapid and/or sustained fire, and when the user is engaged in a military or police action and is not able to periodically inspect the firearm for the possibility of component loosening, the situation could become dangerous for the person using the firearm. The user must be able to rely on the availability of a fully functioning firearm at all times. Primarily it is necessary that the annular hand-guard retainer nut 54 be prevented from rotating and backing off from its fully threaded relation with the threaded section 35 of the hand-guard. To overcome the potential for loosening of the barrel nut and the hand-guard retainer nut of a tactical firearm, according to the principles of the present invention, an anti-rotation clamp assembly shown generally at 60 is integrated with the firearm components and has the function of keying the barrel nut and the hand-guard retainer nut to other firearm structure so that these otherwise rotatable components of the barrel retainer system are prevented from rotation regardless of the manner by which the firearm is handled. The threaded connection of the firearm receiver and hand-guard will remain secure and stable even under the roughest of field conditions.

According to the principles of the present invention it is desired to provide a releasable threaded connection between a receiver and hand-guard that functions to key the barrel nut of an M4 Carbine or other similar firearm to the firearm receiver and also functions to key the hand-guard retainer nut of the firearm both to the receiver and to the hand-guard support and thus prevent inadvertent vibration or shock induced loosening of these retainer nuts. This feature will prevent the hand-guard and receiver of a rifle or other mechanical device from becoming loosened by vibration and shock forces.

As explained above, the firearm receiver member 14 typically defines a sight mounting rail having a forward end 20 which defines a rather abrupt end configuration that is similar to the rail configuration shown at 22 in FIG. 3. The anti-rotation clamp member 60, shown best in the exploded view of FIG. 4, is of arcuate or curved configuration for application to existing firearms, without necessitating significant modification thereof. The anti-rotation clamp member 60 has relatively thick end portions 62 and 64 that each defined screw openings 66 and 68 which are adapted to receive the retainer screw members 43. Between the relatively thick end portions 62 and 64 of the anti-rotation clamp member 60 is provided with a relatively thin intermediate section 70 which cooperates with abrupt shoulders 72 and 74 of the respective end portions 62 and 64 to define an anti-rotation slot 76. The intermediate thin section is typically formed by milling a slot through the center portion of the anti-rotation clamp member. The curved clamp member defines a lower intermediate curved edge 78 that substantially corresponds to the external geometry of the firearm receiver member 14 adjacent the externally threaded annular projection 51 and thus corresponds to the configuration of a standard M-4 carbine. Obviously, this particular geometry is not intended to be limiting of the spirit and scope of the present invention since other firearms and other mechanical devices may have a different external geometry. Also, the anti-rotation clamp member 60 may have a completely different geometry in the event rifle construction is altered to accommodate such anti-rotation features. The relatively thin intermediate section 70 may be provided with an opening 80 which may receive an alignment pin or may receive an orienting and retainer screw to enable the anti-rotation clamp member 60 to be keyed to the forward end portion of the receiver member as desired. The anti-rotation clamp member 60 defines a generally planar clamping surface 82 which is disposed for clamping engagement with an annular end surface 84 of the hand-guard retainer nut 54 to thus secure the hand-guard retainer nut 54 against inadvertent rotation by vibration and shock forces. When the retainer screws, which are preferably Allen type retainer screws are tightened by using a simple Allen wrench, the generally planar clamping surface 82 is forced into clamping engagement with the annular end surface 84 and thus ensures that the hand-guard retainer nut cannot be rotated by hand and it cannot be rotated by the forces of vibration and shock. If desired, the generally planar clamping surface 82 can be prepared with knurling or with any other suitable surface preparation or surface material to ensure its efficient clamping and rotation preventing engagement with the hand-guard retainer nut.

With the hand-guard retainer nut 54 and the barrel nut 44 in place and the hand-guard retainer nut tightened, the anti-rotation clamp plate 60 of generally C-shaped or arcuate configuration is placed in contact with both the hand-guard retainer nut 48 and the barrel retainer nut 36. The external peripheral portion of the arcuate clamp plate 60 contacts the hand-guard retainer nut while the inner peripheral portion of the arcuate clamp plate contacts a projecting circular rim 62 of the barrel nut. The retainer screws 43 are extended through the openings 66 and 68 of the anti-rotation clamp member and through the retainer receptacles or passages 39 and are threaded into the internally threaded nut members 41. The retainer screws are tightened, such as by the use of a simple Allen wrench to cause the clamping plate to establish frictional engagement with both the hand-guard retainer nut 48 and the barrel retainer nut 36, thus preventing relative rotation of these nuts. The retainer screws also extend through two of the multiple weight minimizing openings 52 of the barrel retainer nut 44 and function to key the barrel nut against rotation. The anti-rotation clamp member 60 also defines one or more openings 80 that are aligned with one or more of the weight minimizing openings of the barrel nut and permit drift pins or alignment pins to be inserted for positioning the clamp plate in accurate registry with the hand-guard retainer nut 54 and the barrel nut 44. If desired, the forward end of the receiver Picatinny rail may be provided with an alignment pin that extends through a central opening 80 of the anti-rotation clamp member 60 to function as an additional key to essentially key both the barrel nut and the clamp plate to the receiver of the firearm. The anti-rotation clamp member 60 has a centrally oriented slot 74 which is of appropriate dimension and configuration to receive the front end 20 of the Picatinny rail 22 of the receiver of the firearm and thus establish a non-rotatable relationship of the clamping plate and the receiver of the firearm. This feature ensures against any rotational movement of the clamp plate, the barrel nut 44 and, by virtue of frictional engagement, ensures against any inadvertent rotation of the hand-guard retainer nut as well.

The hand-guard mount 32 is provided with at least one and preferably a pair of alignment pins 38 that project into the circular barrel nut seat 33 and are received by one or two of the evenly spaced weight minimizing openings 52 of the barrel nut 44. The alignment pins 38 essentially key the barrel retainer nut 44 to the hand-guard mount 32 so that inadvertent rotation of the barrel nut 44 relative to the hand-guard mount 32 is prevented. To ensure that the alignment pins 38 are prevented from moving axially due to shock and vibration, threaded passages are formed in the hand-guard mount 32 and intersect the bores or seats within which the alignment pins are seated. The alignment pins 38 are threaded into these internally threaded passages with sufficient force to lock them in place.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. In a thread connected assembly of first and second mechanical components that are subject to vibration or shock forces and having threaded connection, the improvement comprising:

an anti-rotation member being located at said threaded connection and establishing anti-rotation engagement with each of said first and second mechanical components and preventing thread loosening relative rotation of said first and second mechanical components when subjected to vibration or shock forces;

said anti-rotation member having spaced screw openings;

retainer screw members extending through said screw openings and being threadedly received by said first mechanical component; and said anti-rotation member defining an anti-rotation receptacle receiving a part of said second mechanical component therein and preventing relative rotation of said second mechanical component at said threaded connection.

2. The improvement of claim 1, comprising:

said anti-rotation member having at least one locator opening therein; and at least one locator pin projecting from said first mechanical component and engaging within said at least one locator opening.

3. The improvement of claim 1 wherein said threaded connection having first threaded members of a defined thread dimension and second threaded members of a greater thread dimension than said defined thread dimension, said improvement comprising:

said anti-rotation member being of generally C-shaped configuration and having ends each defining said spaced screw openings;

said retainer screws extending through said spaced screw openings and being threaded into said screw openings of said retainer member; and a connection nut member being rotatably mounted to said first threaded member and having releasable threaded connection with said second threaded member, said anti-rotation member establishing anti-rotation clamping engagement with said connection nut member upon tightening of said retainer screws.

4. In a firearm having a firearm receiver member, barrel member and a hand-guard member and having a barrel nut threaded to the firearm receiver member and securing the barrel member to the firearm receiver member and further having a hand-guard retainer nut member being rotatable relative to the firearm receiver member and being threaded to the hand-guard member, the improvement comprising:

an anti-rotation member establishing non-rotatable engagement with the firearm receiver member and with the hand-guard member and preventing vibration or shock induced rotation and loosening of the barrel nut and the hand-guard retainer nut member;

said barrel nut having alignment and retainer screw openings therein;

said anti-rotation member being of generally C-shaped configuration and defining end portions each having a screw opening therein; and retainer screws extending through said screw openings of said end portions of said anti-rotation member and through said retainer screw openings of said barrel nut and securing the barrel nut against rotation relative to the firearm receiver member.

5. The improvement of claim 4, comprising:

said anti-rotation member defining an anti-rotation receptacle having non-rotatable engagement with the firearm receiver member and having a clamping surface being secured in rotation preventing clamping engagement with said hand-guard retainer nut member by said retainer screws.

6. The improvement of claim 5, comprising:

the firearm receiver member having at least one structural rail defining a rail end;

said anti-rotation receptacle of said anti-rotation member being end portions defining a slot therebetween, said slot receiving said rail end in non-rotatable relation therein.

7. The improvement of claim 4, comprising:

said barrel nut being threaded to the firearm receiver member and securing the barrel of the firearm from rotation and loosening of its threaded connection with the firearm receiver member;

a barrel nut and hand-guard mount being disposed in fixed relation with the hand-guard and having a barrel nut receptacle and having a barrel nut anti-rotation alignment element located within said barrel nut receptacle;

a hand-guard retainer nut member being rotatably supported by the receiver and engaging said externally threaded section of said barrel nut and hand-guard mount and securing said barrel nut within said barrel nut receptacle and establishing anti-rotation engagement of said anti-rotation alignment element with said barrel nut; and said anti-rotation member having anti-rotation engagement with the firearm receiver member and having non-rotational clamping engagement with said hand-guard retainer nut.

8. The improvement of claim 7, comprising:

retainer screws extending through said anti-rotation member and through said barrel nut and hand-guard mount; and retainer nuts being fixed to barrel nut and hand-guard mount and receiving said retainer screws.

9. The improvement of claim 7, comprising:

said anti-rotation member defining an anti-rotation receptacle having non-rotatable engagement with the firearm receiver member and having a clamping surface being secured in rotation preventing clamping engagement with said hand-guard retainer nut by said retainer screws.

10. The improvement of claim 9, comprising:

said anti-rotation member having end portions defining an anti-rotation slot therebetween; and the firearm receiver having at least one structural rail defining a rail end being received within said anti-rotation slot and preventing rotation of the firearm receiver member relative to said anti-rotation clamp member.

11. The improvement of claim 4, comprising:

the barrel nut being threaded to the receiver and securing the barrel of the firearm from rotation and loosening of its threaded connection with the firearm receiver member;

a barrel nut and hand-guard mount being disposed in fixed relation to the hand-guard and having a barrel nut receptacle and having at least one barrel nut anti-rotation element located within said barrel nut receptacle;

a hand-guard retainer nut being rotatably supported by the receiver and engaging said externally threaded section of said barrel nut and hand-guard mount and securing said barrel nut within said barrel nut receptacle and establishing anti-rotation engagement of said at least one anti-rotation alignment element with said barrel nut;

said anti-rotation member being a clamp member having anti-rotation engagement with the firearm receiver member and having non-rotational clamping engagement with said hand-guard retainer nut;

said retainer screws extending through said anti-rotation clamp member and through said barrel nut and hand-guard mount;

retainer nuts being fixed to said barrel nut and hand-guard mount and receiving said retainer screws;

said anti-rotation clamp member having end portions defining an anti-rotation slot therebetween and having a clamping surface being secured in rotation preventing clamping engagement with said hand-guard retainer nut by said retainer screws; and the firearm receiver member having at least one structural rail defining a rail end being received within said anti-rotation slot and preventing rotation of the firearm receiver member relative to said anti-rotation clamp member.

12. In a firearm having a firearm receiver member, barrel member and a hand-guard member and having a barrel nut threaded to the receiver member and securing the barrel member to the receiver member and further having a hand-guard retainer member being rotatable relative to the firearm receiver member and being threaded to said hand-guard member, the improvement comprising:

a barrel nut receptacle being defined by said hand-guard member and having at least one alignment and anti-rotation element located therein, said barrel nut receptacle being externally threaded and defining retainer screw receptacles;

said barrel nut having anti-rotation receptacle therein establishing anti-rotatable engagement within said barrel nut receptacle;

a hand-guard retainer nut being rotatably mounted to the firearm receiver member and having threaded engagement with said hand-guard to secure said hand-guard member to the firearm receiver member; and an anti-rotation member establishing non-rotatable engagement with the firearm receiver member and anti-rotation clamping relation with said hand-guard retainer nut and preventing vibration or shock induced rotation and loosening of the barrel nut and the hand-guard retainer nut.

13. The improvement of claim 12, comprising:

said barrel nut having alignment and retainer screw openings therein;

said anti-rotation member being of generally C-shaped configuration and defining end portions each having a screw opening therein; and retainer screws extending through said screw openings of said end portions of said anti-rotation member and through said retainer screw openings of said barrel nut and securing the barrel nut against rotation relative to the firearm receiver member.

14. The improvement of claim 12, comprising:

said anti-rotation member defining an anti-rotation receptacle having non-rotatable engagement with said receiver and having a clamping surface being secured in rotation preventing clamping engagement with said hand-guard retainer nut by said retainer screws.

15. The improvement of claim 14, comprising:

the firearm receiver member having at least one structural rail defining a rail end; and said anti-rotation receptacle of said anti-rotation member being end portions defining a slot therebetween, said slot receiving said rail end in non-rotatable relation therein.

16. The improvement of claim 12, comprising:

said barrel nut being threaded to the receiver and securing the barrel of the firearm from rotation and loosening of its threaded connection with the firearm receiver member;

a barrel nut and hand-guard mount being secured in fixed relation to the hand-guard and having a barrel nut receptacle and having at least one barrel nut anti-rotation element located within said barrel nut receptacle;

a hand-guard retainer nut being rotatably supported by the firearm receiver member and engaging said externally threaded section of said barrel nut and hand-guard mount and securing said barrel nut within said barrel nut receptacle and establishing anti-rotation engagement of said at least one anti-rotation alignment element with said barrel nut; and an anti-rotation clamp member having anti-rotation engagement with the firearm receiver member and having non-rotational clamping engagement with said hand-guard retainer nut.

17. The improvement of claim 16, comprising:

retainer screws extending through said anti-rotation clamp member and through said barrel nut and hand-guard mount; and retainer nuts being fixed to barrel nut and hand-guard mount and receiving said retainer screws.

18. The improvement of claim 17, comprising:

said anti-rotation clamp member defining an anti-rotation receptacle having non-rotatable engagement with the firearm receiver member and having a clamping surface being secured in rotation preventing clamping engagement with said hand-guard retainer nut by said retainer screws, said anti-rotation clamp member having end portions defining an anti-rotation slot therebetween; and the firearm receiver member having at least one structural rail defining a rail end being received within said anti-rotation slot and preventing rotation of the firearm receive relative to said anti-rotation clamp member.

* * * * *